United States Patent [19]

McGee

[11] Patent Number: 4,910,938

[45] Date of Patent: Mar. 27, 1990

[54] WALL STUD FOR PORTABLE/IN-PLANT BUILDING

[75] Inventor: Jerry V. McGee, Chesterfield, Mo.

[73] Assignee: Porta-Fab Corporation, Chesterfield, Mo.

[21] Appl. No.: 286,898

[22] Filed: Dec. 20, 1988

[51] Int. Cl.[4] ..... E04C 1/30

[52] U.S. Cl. ..... 52/588; 52/282; 52/656; 52/731; 52/775

[58] Field of Search ..... 52/36, 79.1, 79.9, 79.12, 52/263, 282, 288, 287, 280, 281, 656, 730, 731, 764, 780, 582, 584, 588, 775, 241, 239, 238.1

[56] References Cited

U.S. PATENT DOCUMENTS

| | | | |
|---|---|---|---|
| 2,156,347 | 5/1939 | McLaughlin, Jr. | 52/282 X |
| 3,152,672 | 10/1964 | Oppenhuitzen et al. | 52/731 X |
| 3,332,179 | 7/1967 | Toti | 52/731 X |
| 3,436,881 | 4/1969 | Schlecht | 52/731 X |
| 3,858,377 | 1/1975 | Browne et al. | 52/775 |
| 4,196,555 | 4/1980 | Hender, Jr. et al. | |
| 4,429,502 | 2/1984 | Kinnebrew, III | 52/263 |

OTHER PUBLICATIONS

Porta-Fab Corporation Brochure entitled, "In-Plant Offices & Portable Buildings", p. 7.

Inplant Offices, Inc. brochure entitled, "Modular Office Systems Engineered to Fit Your Needs", p. 2.

National Partitions and Interiors, Inc. brochure entitled, "The Full Spectrum Builder".

*Primary Examiner*—Richard E. Chilcot, Jr.

*Attorney, Agent, or Firm*—Rogers, Howell & Haferkamp

[57] ABSTRACT

A wall stud for the wall of an in-plant/portable building where the wall includes interfitting wall studs and panels. The wall stud has first and second interfitting stud members that fit in telescoping engagement. Each stud member is generally U-shaped in cross-section with outwardly, laterally extending flanges to sandwich a wall panel therebetween with the members in telescoping engagement. The first stud member has an outwardly angled flange at each side thereof, and the second stud member has an outwardly angled side wall portion at each side thereof such that the angled wall portions and angled flanges are in mating engagement with each other with the members in telescoping engagement. The mating angled side wall portions and angled flanges are adapted to receive a fastener to secure them in mating engagement and thereby secure the stud members in telescoping engagement.

14 Claims, 2 Drawing Sheets

WALL STUD FOR PORTABLE/IN-PLANT BUILDING

BACKGROUND AND SUMMARY OF INVENTION

This invention relates to a wall stud and more particularly to a wall stud for a portably/in-plant building.

The buildings of the type to which the wall stud of this invention relates are prefabricated and ready for assembly at the building site. Such buildings include in-plant offices, guard houses, food service buildings, control rooms, toll booths, parking lot booths, noise control buildings, and the like. These portable buildings must be of quality construction, strong and durable. They should be energy efficient, have good sound control and low maintenance. Other characteristics of such buildings are that they must be relatively easy to assemble at the job site and easily disassembled for moving to a different location if desired. They should also be economical.

Such building structures are well-known in the art as are wall studs for use with such building structures. Typically, such wall studs are of extruded aluminum and have side recesses for receiving the side edges of wall panels to form the walls of the building.

One such prior art wall stud has interfitting telescoping members with lateral flanges which sandwich the wall panels therebetween. One of the members, the exterior member, has a single elongated socket centrally located along its back wall for anchoring screws which extend through the back wall of the other member, the interior member, to fasten them together. Hence, the fasteners or screws are along a single longitudinal line. Another known prior art wall stud has two elongated sockets extending in parallel relationship down the back wall of the exterior member. The side walls of the interior member have lateral shoulders through which fasteners extend and anchor in the longitudinal sockets. However, this known structure has spacing between the shoulders and the sockets which can allow some degree of buckling or twisting under load conditions to which the stud is subjected. Still another wall stud structure, shown by U.S. Pat. No. 4,196,555, has side-by-side members that pivot relative to each other with means for locking the two sections together when pivoted to a predetermined position.

The present invention is an improvement to the wall stud of the type having telescoping members as described above and which provides improved strength and stability under load without sacrificing ease of assembly. In accordance with the present invention there are provided outwardly angled flanges and mating outwardly angled side wall portions at both sides of the stud which firmly seat with each other when the stud members are in telescoping engagement. The firmly seated and mating angled flanges and angled side wall potions receive fasteners at both sides of the stud to secure them in mating engagement and thereby secure the members in telescoping engagement. Once the members are secured the wall studs have exceptional rigidity and strength to carry the transverse, lateral, and vertical loads required by the building structure.

DESCRIPTION OF A PREFERRED EMBODIMENT

Figure 1:
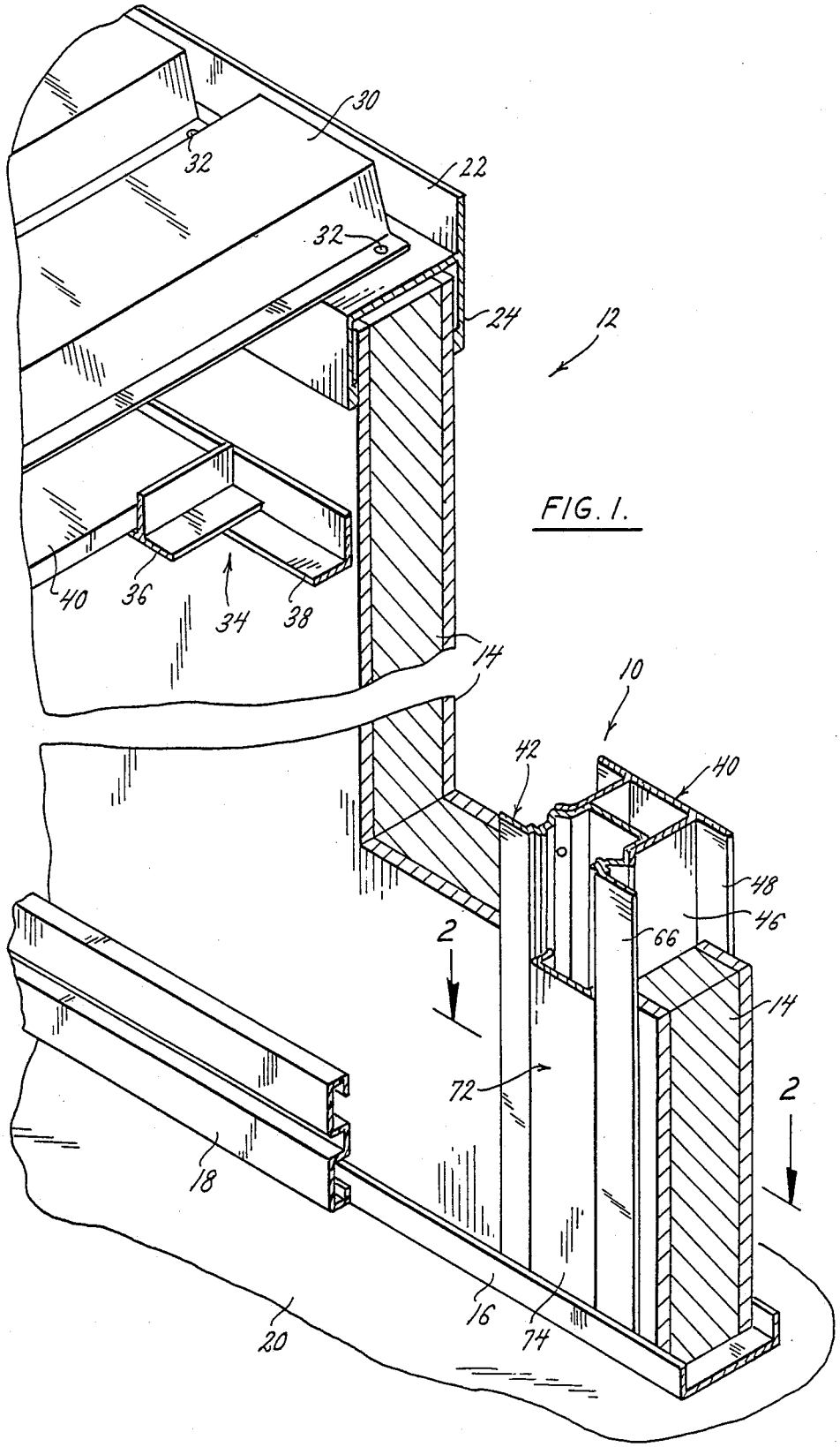
FIG. 1 is a perspective view of a wall, with portions broken away, including a wall stud of the present invention.

With reference to the drawing, the wall stud 10 of the present invention is for use in a wall 12 of a portable or in-plant building of the type previously described. The wall 12 also includes panels 14, a floor track 16 at the base of the studs 10 and panels 14, and a vinyl base 18 that extends along the base of the wall at the floor 20. A cornice mold angle 22 is located at the top of the wall and has a downwardly facing U-shaped channel portion 24 into which the tops of the panels 14 extend. A corrugated dust cover 30 rests on top of the cornice mold and is secured thereto by screws or rivets 32. A lay-in ceiling framework 34 comprised of angle members 36 and 38 is supported beneath the cornice mold and dust cover, and supports suitable ceiling tile 40 to comprise the ceiling for the room.

The wall panels 14 may be of any suitable thickness, but are conventionally 1¾" or 3" thick. The panels may be structured in a variety of ways suitable for prefabricated building structures of the type to which the wall stud of the present invention relates. For example, the wall panel may have a honeycomb core with vinyl covered cardboard on both sides. As another example the wall panel may have a non-combustible insulating core, such as of polystyrene foam, with gypsum outer panels laminated thereto.

Figure 2:
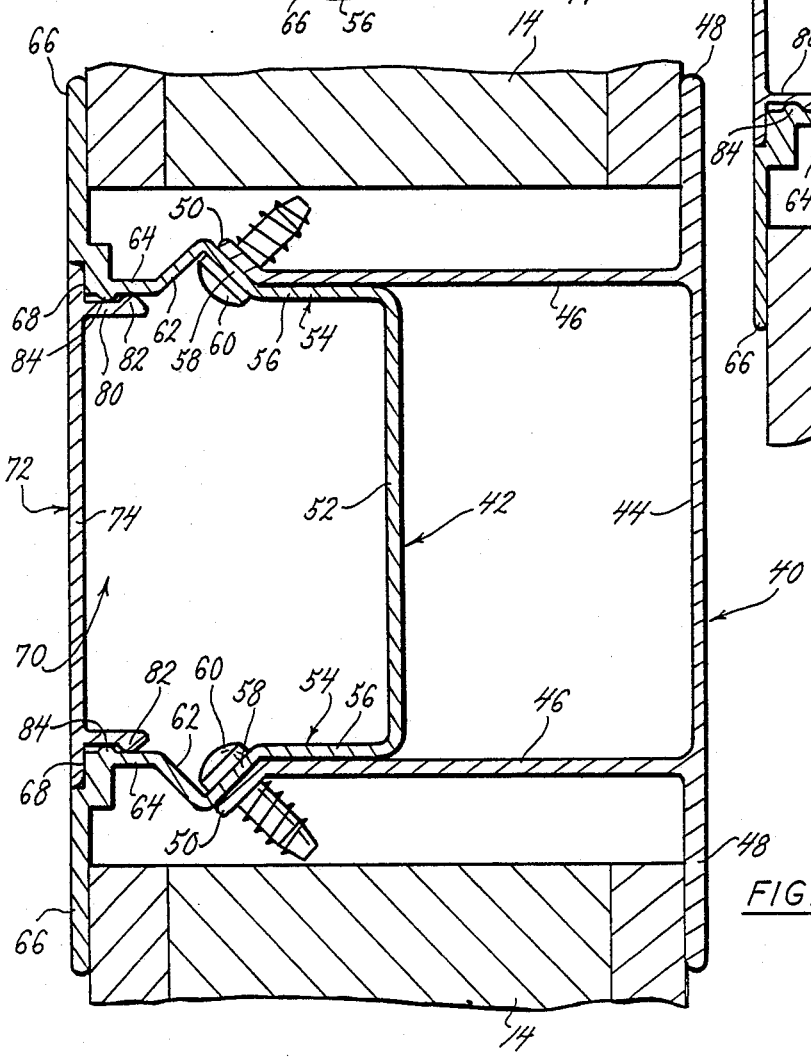
FIG. 2 is a view in section taken generally along the line 2—2 of FIG. 1.

The wall stud 10 of the present invention comprises first (exterior) and second (interior) interfitting stud members 40 and 42 with the second stud member interfitting in telescoping engagement with the first stud member. Each stud member is of generally U-shape cross-section with the open sides of each member facing toward the front (to the left as viewed in FIGS. 2 and 4) with the members in telescoping engagement.

Hence, the member 40 is generally U-shaped in cross-section as shown having a back wall 44 parallel to the plane of the room wall, and side walls 46 extending forwardly of the rear wall at right angles thereto. Flanges 48 extend laterally outwardly from the rear wall 44. The forward ends of the side walls 46 have outwardly angled flanges 50.

The stud member 42 is also generally U-shaped in cross-section and has a rear wall 52 which is parallel to the rear wall 44, and has side walls 54 extending forwardly of the rear wall 52 at right angles thereto. Portions 56 of the side walls 54 are in closely fitting relationship to the side walls 46 with the members in telescoping engagement as shown.

Each side wall 54 has an outwardly angled side wall portion 58 at the same angle as, and that mates with, the outwardly angled flange 50. With the stud members in telescoping engagement, the outwardly angled side wall portions 58 seat against the outwardly angled flanges 50 providing mating engagement. Fasteners such as sheet metal screws 60 extend through suitable openings in the mating side wall portions and flanges to secure them in mating engagement and thereby secure the stud members in telescoping engagement. The walls 54 also include inwardly angled side wall portions 62 extending from said outwardly angled side wall portions 58. Additional side wall portions 64 extend forwardly from the inwardly angled portions 62 to outwardly extending lateral flanges 66.

The flanges 66 have recesses 68 next to the front opening 70 of the stud 10 to receive a stud cover 72. The stud cover comprises a cover plate 74 that covers the opening 70 and fits within the recesses 68 to present with the flanges 66 a substantially flat front surface for the wall stud 10. The pate has rearwardly extending flanges 80 near each side edge thereof with an outwardly facing rib 82. Complimentary inwardly facing ribs 84 are located on the wall portions 64 near the opening 70. The complimentary ribs 82 and 84 comprise means for snapping engagement of the stud cover with the second member to hold the cover in place.

In this preferred embodiment the angled flanges 50 and angled side wall portions 58 are angled at 45° to the plane of the wall. This angle is preferred although any angle may be used that will provide a suitable seating or mating engagement between the angled side wall portions and angled flanges and also provide clear access for installing the fasteners 60. Each of the members 40 and 42, and the stud cover 72 is formed by extrusion and may be aluminum or other suitable material for supporting the vertical loads of the building structure. The angled side wall portions and angled flanges not only provide a means for securing the stud members together in telescoping engagement, but also provide rigidity and strength to the wall stud to carry the transverse, lateral, and vertical loads required by the building structure.

Figure 4:
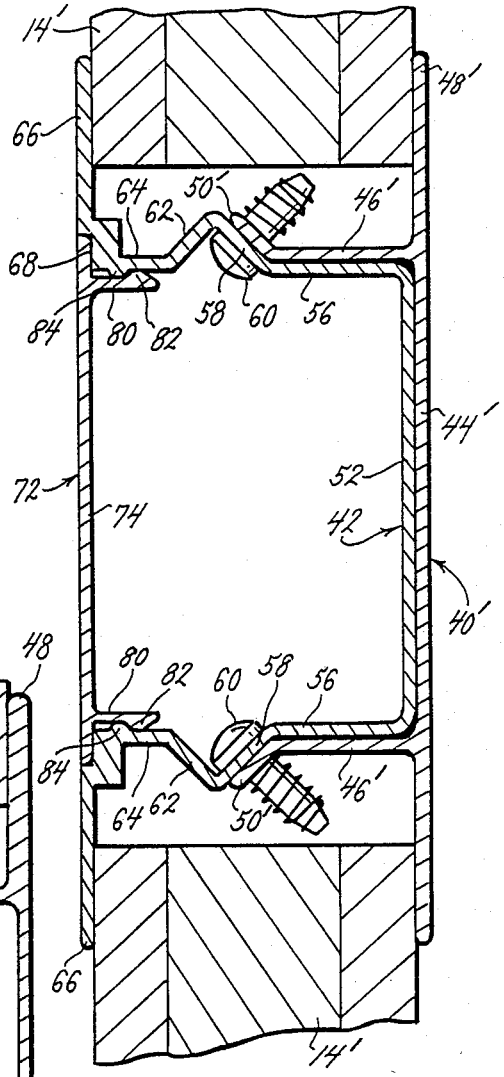
FIG. 4 is a sectional view similar to FIG. 2 but showing a modification of the invention.

With the stud members in telescoping engagement, the flanges 48 and 66 at each side of the wall stud are in spaced relation such that a panel 14 is sandwiched therebetween. As previously mentioned, the panels 14 may be of different thicknesses. FIG. 4 shows a wall stud of the present invention used with narrow panels, such as for example 1¾" thickness while the other figures of the drawing show the wall stud of the present invention used with thicker wall panels, such as for example 3" thick. The dimensions of the stud member 42 are the same for both panel thicknesses. Only the lengths of the side walls 46' of the stud member 40' are changed to accommodate the different panel thicknesses.

Figure 3:
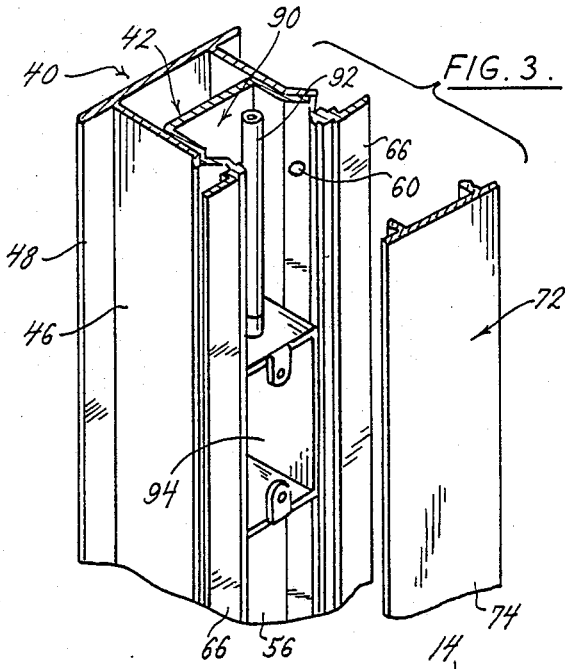
FIG. 3 is a perspective view a wall stud of the present invention.

It will further be noted that the interior chamber 90 within the second stud member 42 and cover 72 defines an electrical raceway for running electrical conduit 92 and electrical wiring boxes 94 as shown in FIG. 3.

There are various changes and modifications which may be made to the invention as would be apparent to those skilled in the art. However, these changes or modifications are included in the teaching of the disclosure, and it is intended that the invention be limited only by the scope of the claims appended hereto.

I claim:

1. A wall stud for a wall of an in-plant/portable building where the wall includes interfitting wall studs and wall panels, the stud comprising:

first and second interfitting stud members, the second stud member interfitting in telescoping engagement within the first stud member, each stud member being generally U-shaped in cross-section, with open sides of each member facing in a forward direction with the members in telescoping engagement, each member having outwardly, laterally extending flanges, the flanges of one member being in spaced parallel relation to the flanges of the other member to sandwich a wall panel therebetween with the members in telescoping engagement, said first stud member having an outwardly and forwardly angled flange at each side thereof, said second stud member having an outwardly and forwardly angled side wall portion at each side thereof, an angled wall portion and an angled flange being in mating engagement with each other with said members in telescoping engagement, each angled side wall portion being at the same angle as the angled flange with which it mates, each mating angled side wall portion and angled flange adapted to receive a fastener therethrough to secure each angled wall portion and angled flange in mating engagement and thereby secure the members in telescoping engagement.

2. The wall stud of claim 1 wherein said angled side wall portions and angled flanges are angled at about 45° relative to said wall.

3. The wall stud of claim 1 wherein said second stud member has an inwardly angled side wall portion at each side thereof extending from said outwardly angled side wall portion.

4. The wall stud of claim 1 wherein said stud members have forwardly extending side wall portions in closely fitting relationship to each other with said members in telescoping engagement.

5. The wall stud of claim 1 further comprising a removable stud cover over the front opening of the second member, and means for removably mounting said stud cover to said second member.

6. The wall stud of claim 5 wherein said stud cover further comprises a cover plate extending over said front opening, said second member having a recess at each side thereof receiving the cover plate, the cover plate and lateral flanges of said second member presenting a generally flat outer front surface, said plate having rearwardly extending flanges, and means for snapping engagement of said stud cover with said second member.

7. A wall stud assembly for a wall of interfitting wall studs and wall panels, the stud assembly comprising:

first and second interfitting stud members, each stud member having a general U-shape with a back wall and a pair of opposed side walls extending forward from the back wall and generally normal to the back wall, the side walls of the first stud member being spaced apart and the back wall and side walls of the second stud member being inserted between the side walls of the first stud member with the side walls of the first and second stud members being in close proximity, forward edges of the side walls of the first stud member being formed as flanged angled outwardly from the side walls of the first stud member at obtuse angles to the side walls, and sections of the side walls of the second stud member being angled outwardly at substantially the same angles as the forward flange edges of the side walls of the first stud member.

8. The wall stud assembly of claim 7 comprising:

the angled sections of the side walls of the second stud member being between coplanar forward and rearward sections of the side walls of the second stud member.

9. The wall stud assembly of claim 7 comprising:

the angled sections of the side walls of the second stud member and the angled flanged of the side walls of the first stud member being adapted to mutually contact and to be secured together, securing the first stud member to the second stud member.

10. The wall stud assembly of claim 9 comprising:

the back wall of the first stud member being spaced from the back wall of the second stud member with the angled sections of the side walls of the second stud member and the angled flanges of the side walls of the first stud member in mutual contact.

11. The wall stud assembly of claim 9 comprising:

the back wall of the first stud member being in close proximity to the back wall of the second stud member with the angled sections of the side walls of the second stud member and the angled flanges of the side walls of the first stud member being in mutual contact.

12. The wall stud assembly of claim 7 comprising:

the first stud member having side flanges extending outwardly, laterally from opposite side edges of the first member back wall;

the second stud member having side flanges extending outwardly, laterally from forward edges of the second member side walls;

the side flanges of the first and second stud members being parallel and adapted to receive a wall panel between a side flange of the first member and a side flange of the second member.

13. The wall stud assembly of claim 9 comprising:

the angled side wall flanges of the first stud member and the angled side wall sections of the second stud member each being adapted to receive a fastener therethrough to secure the side wall flanges to the side wall sections.

14. The wall stud assembly of claim 13 comprising:

the fastener received by each side wall flange and each side wall section being positioned at an angle to the side walls of both the first and second stud members.

* * * * *